United States Patent [19]

Wietschorke et al.

[11] Patent Number: 4,756,286

[45] Date of Patent: Jul. 12, 1988

[54] DEVICE FOR REGULATING THE IDLING SPEED OF AN INTERNAL COMBUSTION ENGINE

[75] Inventors: Stephan Wietschorke, Usingen; Andreas Sausner, Frankfurt am Main, both of Fed. Rep. of Germany

[73] Assignee: VDO Adolf Schindling AG, Frankfurt am Main, Fed. Rep. of Germany

[21] Appl. No.: 799,182

[22] Filed: Nov. 14, 1985

Related U.S. Application Data

[63] Continuation of Ser. No. 631,031, Jul. 16, 1984, abandoned.

[30] Foreign Application Priority Data

Jul. 15, 1983 [DE] Fed. Rep. of Germany ..... 3325538

[51] Int. Cl.[4] ..... F02M 3/00

[52] U.S. Cl. ..... 123/339; 251/129.09; 364/431.07

[58] Field of Search ..... 364/431.07; 123/339, 123/585, 586, 587; 335/261, 262, 266, 267, 268, 259; 137/529; 251/129.09, 129.1

[56] References Cited

U.S. PATENT DOCUMENTS

| | | | |
|---|---|---|---|
| 2,168,927 | 8/1939 | Adams et al. | 251/129.1 |
| 3,190,608 | 6/1965 | Hassa | 335/259 |
| 3,424,426 | 1/1969 | Neff | 251/30.03 |
| 3,688,495 | 9/1972 | Fehler et al. | 60/741 |
| 4,097,833 | 6/1978 | Myers | 335/261 |
| 4,132,199 | 1/1979 | Kurolwa et al. | 123/440 |
| 4,144,514 | 3/1979 | Rinde et al. | 251/129.1 |
| 4,176,639 | 12/1979 | Shinoda et al. | 123/520 |
| 4,361,309 | 11/1982 | Sogabe | 251/129.09 |
| 4,378,766 | 4/1983 | Yamazoe et al. | 123/339 |
| 4,422,060 | 12/1983 | Matsumoto et al. | 335/266 |
| 4,434,933 | 3/1984 | Tamura | 251/129.1 |
| 4,464,977 | 8/1984 | Brundage | 137/529 |

FOREIGN PATENT DOCUMENTS

| | | | |
|---|---|---|---|
| 636649 | 5/1950 | United Kingdom | 251/137 |

*Primary Examiner*—Gary Chin

*Attorney, Agent, or Firm*—Martin A. Farber

[57] ABSTRACT

In a device for regulating the idling speed of an internal combustion engine by varying the feed by means of an electromechanical setting member which is provided with electromagnetic means developed as solenoid with at least one coil (spaces 14, 15; 36, 37), with ferromagnetic parts which conduct magnetic flux (cylindrical return sleeves 1, 19, 20), with at least one core (12, 13; 23) which can be influenced by the flux and with a magnetic flux-conducting element (push rod 9, 31) which is connected to the core, means are provided in order to set the valve element, when the excitation of the coils is interrupted, in an idling position of medium rate of flow of air. In order to maintain the structural expense for these means small and to obtain linearization of the normal manner of operation of the device with a large useful yield of force, the electromechanical setting member comprises two coils (within frames 14, 15 and 36, 37 respectively). These coils are so connected and acted on by setting currents that they act in directions opposite to each other on the element conducting the magnetic flux (push rod 9 or 31 respectively) by means of at least one core (12, 13 or 23 respectively). The means producing the return force (opposing spring 17 and adjustment spring 19 or opposing spring 32 and adjustment spring 29 respectively) are so developed that when the coils are without current the valve element is brought into a position of medium rate of flow of air.

11 Claims, 1 Drawing Sheet

DEVICE FOR REGULATING THE IDLING SPEED OF AN INTERNAL COMBUSTION ENGINE

FIELD AND BACKGROUND OF THE INVENTION

The invention relates to a device for regulating the idling speed of an internal combustion engine.

A device for regulating the idling speed of an internal combustion engine by varying the feed comprises an electromechanical setting member which has electromagnetic means which are developed as solenoid and have at least one coil, ferromagnetic parts conducting magnetic flux, at least one core which can be influenced by the flux and a magnetic flux-conducting element connected to the core for adjusting a valve element against a return force, as well as means for maintaining the valve element in a position of medium rate of air flow upon an interruption in the feeding of setting current to the coil.

Devices are used to regulate the idling speed in order, in particular in automotive vehicles, to set the lowest possible speed of rotation which results in favorable consumption and emission values. With constant feed of the internal combustion engine, variations in idling speed may occur, in particular, due to different loads caused by auxiliary units. In addition to this, at low idling speed the operating condition of an internal combustion engine is close to the unstable speed range within which the engine may stall upon further additional load. For this reason, the rate of flow of the air or the feed upon idling is not permanently set but is regulated in accordance with the variations in the idling speed. For this purpose, a solenoid is acted on by a setting current which is formed, inter alia, as a function of the actual speed of rotation and which effects such a displacement of the valve element connected to the solenoid that the actual speed of rotation reaches a predetermined desired speed substantially independently of any disturbing variables.

Normally, known devices for regulating the idling speed are developed in detail in such a manner that when the solenoid is without current the valve element is held either in the fully open or fully closed position by the return spring. Only when the solenoid is acted on by the setting current does the valve element move against the force of the return spring into a middle position between said two end positions until equilibrium prevails between the magnetic force and the force of the return spring.

In the case of a failure of the device which produces the setting current or of a disturbance in the solenoid, the internal combustion engine will accordingly be operated either with the greatest possible rate of flow of air in the idling range, which normally results in an undesirably high idling speed, or else with a minimum rate of flow of air with the danger of stalling.

In order that even in the event of the failure of the solenoid or of the current actuating it there is automatically set a medium idling rate of flow of air which makes it possible to expect an idling operation which is satisfactory for most conditions of load of the internal combustion engine, a device of the aforementioned type has been proposed. It is characterized by the features that a ferromagnetic actuating element is arranged within the region of influence of the solenoid, the said element being displaceable by at least one auxiliary spring with respect to the valve element up to a stop which is in fixed relationship to the valve element, and that the auxiliary spring is so dimensioned relative to the return spring that when the solenoid is without current, the valve element is maintained in the position of medium rate of flow of air by the action in opposite directions of the auxiliary spring and the return spring.

The automatic setting of a medium rate of flow of air when the solenoid is without current is obtained, in accordance with a previous system, by the action of the auxiliary spring, via the actuating element, on the valve element in opposition to the force of the return spring. When the solenoid is without current, the actuating element is, namely, held against the stop by the auxiliary spring and thereby positions the valve element in a medium position while, without the auxiliary spring, the valve element would be held in an end position by the action of the return spring. In this medium position of the valve element an equilibrium of forces has been established by the deformations of the return spring and auxiliary spring which correspond to this position. On the other hand, if the solenoid is acted on by a setting current when the control is properly operating, it attracts the ferromagnetic actuating element against the force of the auxiliary spring so that the actuating element is detached from the stop. As a result, the valve element is adjusted, as customary, independently of the actuating element and the auxiliary spring, solely in accordance with the equilibrium of forces between the solenoid and the return spring. The function of the actuating element presupposes such a development of the solenoid that the magnetic fluxes can pass from the solenoid into the region of the ferromagnetic actuating element so as to produce the desired action of force on the latter. The solenoid, therefore, must not be completely magnetically closed in the region of the actuating element. This device results in considerable additional expense in the region of the solenoid. In addition, this device, in the same way as similar devices which do not provide for additional measures for setting a medium rate of idling-air flow, tends to operate with a non-linear course of the force/stroke curve. This is due in particular to changes in the air gap as a function of the solenoid. It has heretofore been attempted to straighten the curve by having parts of the magnet which conduct magnetic flux excited up to magnetic saturation in individual regions. Due to the relatively poor magnetic conductivity within the saturation region this, however, necessarily resulted in a reduction in the force which could be used for the displacement of the valve element.

It is an object of the invention to develop a device of the aforementioned type in such a manner that the device assures a medium rate of flow of air upon idling operation when the setting current or solenoid has failed, by means having few mechanical parts and that it makes possible, in disturbance-free operation, a substantially linear course of the force/stroke curve as well as relatively large setting forces.

SUMMARY OF THE INVENTION

According to the invention, the electromechanical setting member comprises two coils (in spaces 14, 15 and 36, 37 respectively) which, upon being acted on by two setting currents in direction opposite to each other, act on the element conducting the magnetic flux (push rod 9 and 31 respectively) by means of at least one core (12, 13 and 23 respectively), and that the means producing the return of force are developed in such a manner that when the coils are without current the valve element is set in a position of medium rate of flow of air.

The invention is based on the principle that two magnetic fluxes are produced by two coils which are traversed by setting currents which produce, on an element conducting the magnetic flux, namely the push rod, forces acting in opposite directions through at least one core arranged on said element. The fluxes produced by the two coils are so conducted by the ferromagnetic parts, including the core or cores, that they affect each other as little as possible. As a result of the individual magnet systems thus acting in opposition to each other on the push rod, non-linearities due to changes in air gap or non-linear magnetization curves are substantially counteracted. Therefore, the coil or coils and the ferromagnetic parts conducting the magnetic flux can be so dimensioned that saturation does not occur in any region of the ferromagnetic parts. In this way, for given setting currents, it is possible to obtain relatively large setting forces which can be used for the displacement of the valve element. In case of disturbances, if the feeding of the setting currents to the coils is interrupted or the coils themselves develop defects, the push rod automatically, under the action of the means producing the return force, positions itself in such a way that the valve element assumes a position of medium rate of flow of air. Thus, in case of a disturbance no structural parts change their position within the magnetic circuit, so that to this extent also no discontinuities or non-linearities can occur. Rather, the push rod and thus the valve element assume, when the two coils are without current, practically the same position as in the event that the coils acted on by setting currents produce magnetic fluxes of the same magnitude. Rather, for the displacement of the valve element in normal bypass operation there is of importance only the ratio of the setting currents in the two coils, which cause corresponding fluxes in the magnetic circuits associated with them.

As the means which produces the return force and which acts on a push rod (9 or 31) as element conducting the magnetic flux there are provided preferably two springs (17, 19 or 29, 32) which act in opposite directions on the push rod. One of the two springs, a so-called opposing spring, is connected with the valve element without the interposition of the push rod, while the second of the two springs, a so-called adjustment spring, acts in case of disturbance on the push rod in order to adjust the medium rate of flow of air.

Within the spring arrangement there is preferably provided a third spring (decoupling spring 18 or 30) which is arranged between one end of the push rod (9 or 31) and the valve element against which third spring an opposing spring (17 or 32) of the two springs acts. A path communicates from the common coupling place between the opposing spring and the third spring to the valve element. By this arrangement of the third spring, the push rod and the valve element can be placed in oscillation by the excitation of the coils so as to avoid a mechanical hysteresis which would distort the setting of the valve element.

One suitable embodiment of the invention is characterized by the fact that the two coils are arranged in a common return sleeve (1) which is preferably developed symmetrically to a central cross sectional plane (8), that each coil has associated with it a ferromagnetic core (12 or 13), and that the two cores are separated by a gap of low permeability. It is characterized by a common return sleeve for both decoupled magnetic circuits. The magnetic flux in each circuit is formed by a different one of the two coils. The two magnetic circuits are decoupled by the gap of low permeability between the two cores provided on the push rod.

Corresponding to the ratio of the setting currents through the two coils, forces are produced in the two cores opposite the return sleeve which act in opposition to each other on the push rod. The push rod accordingly adjusts itself in accordance with the ratio of the setting currents in the coils, while overcoming the return forces.

With an advantageous supporting of the push rod in the outer ends of the return sleeve, the said embodiment is particularly suitable since the adjustment of the bearings in the return sleeve, which is developed as a single piece, is made possible without further assembly and adjustment expense.

In the embodiment of the device having the common return sleeve and two magnetically separated cores, the push rod is produced, in any event in the section between the two cores, of material of the lowest possible permeability so that the two magnetic circuits are decoupled. On the other hand, a material should be selected or additional measures taken such as to keep the wear of the push rod at the bearing points small. Accordingly, both cores (12, 13) are arranged on a push rod (9) which consists of non-magnetic material.

The push rod can be developed more favorably from the standpoint of its material if it bears a common core, corresponding to the particularly preferred embodiment. In this case a common core (23) is surrounded by two return sleeves (19, 20) separated by an air gap (around the cross sectional plane 28), a coil being arranged in each of said sleeves. In this case there is provided for each coil a separate return which—with the exception of one end through which the core can pass—is substantially closed. The magnetic decoupling takes place in this case by an air gap between the two return sleeves. The push rod (9 or 31) can in this connection be supported in one outer end of each of the two return sleeves.

The device can be developed particularly compactly in the manner that the springs provided (29 and 30) are arranged one each in an outer end (2 or 3) of the return sleeve(s).

BRIEF DESCRIPTION OF THE DRAWING

With the above and other objects and advantages in view, the present invention will become more clearly understood in connection with the detailed description of preferred embodiments when considered with the accompanying drawing, of which.

DETAILED DESCRIPTION OF THE PREFERRED EMBODIMENTS

Figure 1:
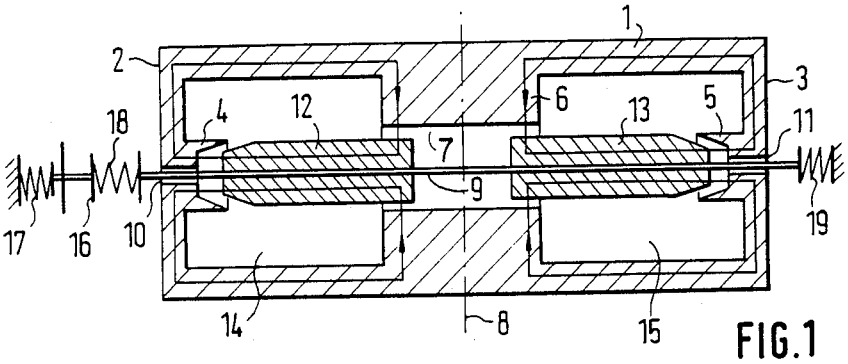
FIG. 1 is a longitudinal section through a first embodiment of the device having a common return sleeve.

In FIG. 1, a magnetic circuit is formed with a common cylindrical return sleeve designated 1, and having outer ends 2, 3 which terminate on the inside in conical pole shoes 4 and 5. In order to note the more detailed shaping of the conical pole shoes reference is had to the drawing. The return sleeve is thickened in the manner of a flange in the middle on its inner side. The flange has a cylindrical recess 7. The entire cylindrical return sleeve is developed symmetrical to a central cross sectional plane 8. The return sleeve consists of ferromagnetic material.

A push rod 9 which extends through the inside of the return sleeve is supported in bearings 10 and 11 in the outer ends 2 and 3. The push rod consists of non-magnetic material, at least in the region of the recess 7. The push rod is displaceable in axial direction in the bearings 10 and 11 and is shown in a central position in FIG. 1.

The magnetic circuit bears two cores 12 and 13, which also consist of ferromagnetic material. Each core has a frustoconical first end facing the conical pole shoe 4 or 5 respectively while its second end extends into the recess 7.

Spaces 14 and 15, each of which surrounds one of the two cores 12, 13 within the sleeve, are filled essentially by a coil, not shown in the drawing. Each coil can be acted on with a setting current by a control circuit arrangement, also not shown in the drawing. The setting currents can in this connection have the form of clocked square pulses the duty cycles of which can be set independently of each other. The duty cycles of the pulses and their phase can be freely set since there is no mutual influence in the magnetic circuits of the two coils.

Figure 2:
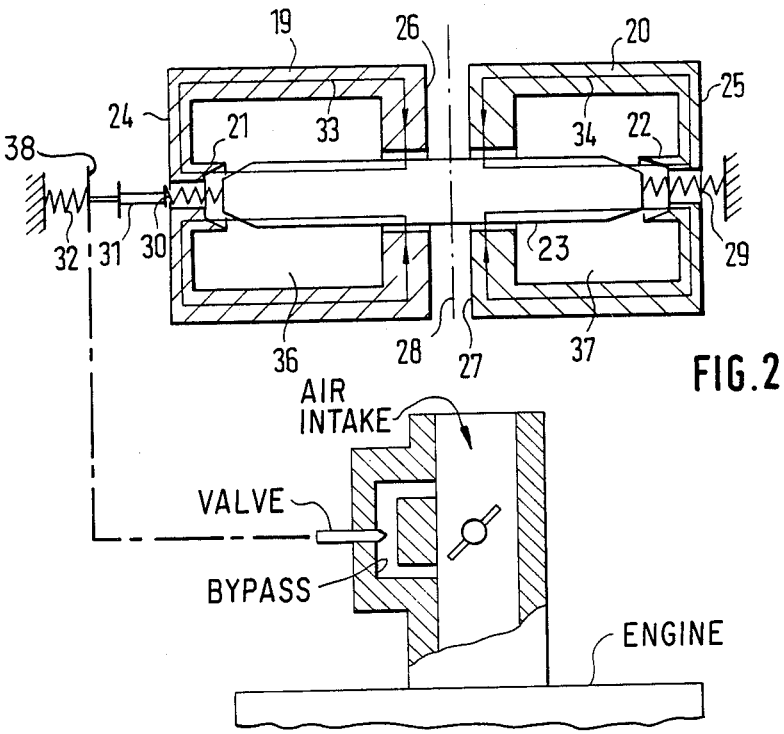
FIG. 2 is a longitudinal section through a second embodiment having two separate return sleeves.

A valve element, not shown in FIG. 1, but disclosed in FIG. 2, is connected to a coupling place 16. An opposing spring 17 attempts to press the valve element against a decoupling spring 18 which is connected in series with the push rod. Against the opposite end of the push rod there acts an adjustment spring 19 by which the central position of the push rod, when the coils are without current, and thus the medium air-flow position of the valve element, can be adjusted. The same central position is assumed by the push rod when the setting currents in the two coils have the same average values.

As a result of the clocked pulses of the setting currents the push rod is excited to enter into vibrations which promote displacement of the push rod free of mechanical hysteresis. This oscillation is decoupled in particularly suitable manner from the valve element by the decoupling spring 18.

The embodiment shown in FIG. 2 has two cylindrical return sleeves 19 and 20 which are aligned with each other, each of them having on the inside of one of its ends a conical pole shoe 21 and 22 respectively. Within the two return sleeves 19 and 20 there is supported a common core 23 which consists of ferromagnetic material also in its central section. The two return sleeves are developed on their sides facing away from the ends 24, 25 with a flange 26 and 27 respectively which extends up to the core. By means of the flanges the magnetic flux paths are decoupled in the region of a central cross sectional plane 28.

In this embodiment the adjustment spring 29 is arranged in space-saving manner in the outer end 25. Analogous to this, a decoupling spring 30 is present in the outer end 24. The push rod 31 connects the decoupling spring to the valve element 38 (indicated in a stylized fashion at an air intake to an engine) on which an opposing spring 32 acts.

The manner of operation of this device, which is shown in its central position, is substantially the same as that of the device shown in FIG. 1. However, in this case we have the advantageous decoupling of the two magnetic circuits 33 and 34 outside the return sleeves, within the region of the central cross sectional plane. The magnetic fluxes are once again produced by, in each case, a coil (not shown in the drawing) within a space 36 and 37 respectively which is practically completely surrounded by the ferromagnetic parts of the return sleeve which conduct the magnetic flux.

The manner of construction of the embodiment of FIG. 2 can be kept particularly compact in view of the substantial decoupling of the magnetic circuits in the region of the central cross sectional plane.

A drive circuit for providing electric current pulses to coils which surround the cores 12, 13 is well known, one such circuit being shown in U.S. Pat. No. 4,132,199, issued in the name of Kuroiwa, et al on Jan. 2, 1979. Thereby, the current pulses activate the electromechanical setting member or actuator. The patent also shows intake structure for an engine, a simplified view thereof being shown in FIG. 2.

We claim:

1. In a device for regulating the idling speed of an internal combustion engine by varying a flow of fluid fed into the engine, the device including an electromechanical actuator which has electromagnetic means comprising a solenoid incorporating at least one coil; said actuator further comprising ferromagnetic parts conducting magnetic flux, at least one core moveable in response to the flux, and a connecting element driven by movement of the core for adjusting a valve element against a return force; said device further comprising means for maintaining the valve element in a position of a medium rate of air flow upon an interruption in a supply of current to the coil, the improvement wherein said electromechanical actuator comprises two coils responsive to coil currents in opposite directions for acting on the connecting element by imparting a movement to said at least one core, the coil currents being present simultaneously to produce forces in opposite directions, said coils being electromagnetically decoupled to allow said coil currents to be generated independently of each other, a ratio of the magnitudes of the currents establishing the amount of force exerted by magnetic fields of the two coils upon the connecting element and a resultant displacement of the valve element; said device further comprising means for producing the return force, said force producing means being responsive to the coil currents in such a manner that when the coils are without current the valve element is set in a position of medium rate of flow of air, said force producing means including first and a second spring located at opposite ends of said connecting element for counteracting forces induced by said magnetic flux, said force producing means including a third spring means located between said first and said second spring means for isolating said valve element from a pulsation in movement of said connecting element resulting from a pulsation in a coil current.

2. The device according to claim 1, wherein said connecting element is a push rod and wherein said means which produces the return force acts on said push rod.

3. The device according to claim 2, wherein said first spring is connected with the valve element on a side thereof opposite the push rod, and said second spring is an adjustment spring which acts in case of a disturbance on the push rod to set a medium rate of flow of air.

4. The device according to claim 2, wherein in said force producing means said third spring is positioned between one end of said push rod and said valve element, and wherein one of said first and second springs is an opposing spring which acts against said third spring.

5. The device according to claim 1, further comprising a common return sleeve which is preferably developed symmetrically to a central cross sectional plane of said actuator; and wherein said two coils are arranged in said common return sleeve;

there being two cores of ferromagnetic material in alignment with each of said coils, respectively, and wherein said two cores are separated by a gap of low permeability.

6. The device according to claim 5, wherein said connecting element comprises a push rod made of non-magnetic material, and wherein both of said cores are disposed on said push rod.

7. The device according to claim 1, further comprising two return sleeves separated by an air gap around a cross sectional plane of said device, there being only one core common to both of said sleeves, which sleeves surround said common core, and wherein a coil is arranged in each of said sleeves.

8. The device according to claim 5, wherein said connecting element is a push rod; and said push rod is supported in one outer end of each of the two return sleeves.

9. The device according to claim 2, wherein said device further comprises at least one sleeve enclosing said connecting element, said first and second springs being located one each in outer ends of the return sleeve(s).

10. The device according to claim 7, wherein said springs are located one each in outer ends of said sleeve(s).

11. In a device for regulating the idling speed of an internal combustion engine by varying a flow of fluid fed into the engine, the device including an electromechanical actuator which has electromagnetic means comprising a solenoid incorporating at least one coil; said actuator further comprising ferromagnetic parts conducting magnetic flux, at least one core moveable in response to the flux, and a connecting element driven by movement of the core for adjusting a valve element against a return force; said device further comprising means for maintaining the valve element in a position of a medium rate of air flow upon an interruption in a supply of current to the coil, the improvement wherein said electromechanical actuator comprises two coils responsive to coil currents in opposite directions for acting on the connecting element by imparting a movement to said at least one core, the coil currents being present simultaneously to produce forces in opposite directions, a ratio of the magnitudes of the currents establishing the amount of force exerted by magnetic fields of the two coils upon the connecting element and a resultant displacement of the valve element; said device further comprising means for producing the return force, said force producing means being responsive to the coil currents in such a manner that when the coils are without current the valve element is set in a position of medium rate of flow of air, and wherein said ferromagnetic parts are configured for decoupling said coils inductively to permit independent generation of said coil currents free of mutual inductance, said connecting element being free to vibrate in response to pulses of said coil currents, said actuator further comprising means connecting between said connecting element and valve element for decoupling vibrations of said connecting element from said valve element; and wherein said force producing means and said vibration decoupling means include a first and a second spring means, respectively, which are mechanically coupled together at one end of said connecting element.

* * * * *